US011110476B2

(12) United States Patent
Meyers

(10) Patent No.: US 11,110,476 B2
(45) Date of Patent: Sep. 7, 2021

(54) WEIGHTED MULTITUBE FLUID DISPENSER

(71) Applicant: Aaron Meyers, Boynton Beach, FL (US)

(72) Inventor: Aaron Meyers, Boynton Beach, FL (US)

( * ) Notice: Subject to any disclaimer, the term of this patent is extended or adjusted under 35 U.S.C. 154(b) by 0 days.

(21) Appl. No.: 16/503,881

(22) Filed: Jul. 5, 2019

(65) Prior Publication Data

US 2020/0009595 A1 Jan. 9, 2020

Related U.S. Application Data

(60) Provisional application No. 62/694,228, filed on Jul. 5, 2018.

(51) Int. Cl.

| | |
|---|---|
| ***B05B 15/00*** | (2018.01) |
| ***B05B 9/08*** | (2006.01) |
| ***B05B 11/00*** | (2006.01) |
| ***B05B 15/33*** | (2018.01) |
| *B05B 15/30* | (2018.01) |

(52) U.S. Cl.

CPC ..... *B05B 15/33* (2018.02); *B05B 9/085* (2013.01); *B05B 11/30* (2013.01); *B05B 11/3057* (2013.01); *B05B 15/30* (2018.02)

(58) Field of Classification Search

CPC ..... B05B 11/3057; B05B 15/30; B05B 15/33; B05B 11/30; B05B 9/085

See application file for complete search history.

(56) References Cited

U.S. PATENT DOCUMENTS

| | | | | |
|---|---|---|---|---|
| 5,339,990 | A * | 8/1994 | Wilder | B05B 11/3001 222/135 |
| 5,526,963 | A | 6/1996 | Smith | |
| 5,655,714 | A * | 8/1997 | Kieffer | B05B 7/2402 239/318 |
| 5,769,284 | A * | 6/1998 | Vargas | B67D 7/0277 222/464.4 |
| 6,776,308 | B1 * | 8/2004 | Davis | B01F 5/0077 137/266 |
| 7,097,119 | B2 * | 8/2006 | Hornsby | B05B 15/33 239/451 |
| 8,579,165 | B2 * | 11/2013 | Kim | B05B 15/30 222/382 |
| 9,604,238 | B2 * | 3/2017 | Geldard | B05B 15/30 |

(Continued)

*Primary Examiner* — Frederick C Nicolas
(74) *Attorney, Agent, or Firm* — Boudwin Intellectual Property; Daniel Boudwin

(57) ABSTRACT

A weighted multitube fluid dispenser designed to allow a user to efficiently dispense fluid stored in a bottle regardless of how they tilt the bottle. The weighted multitube fluid dispenser includes a bottle having an opening at a top end disposed opposite a bottom end and in communication with an interior designed to store liquid therein. A spray head is designed to secure overtop the opening via a rim. A hose extends from the spray head and splits into a plurality of tubes, each tube having an aperture at one end with a weight affixed. The spray head includes a nozzle in communication with the hose, and a trigger in communication with the nozzle. Thus, activating the trigger causes fluid in the bottle to traverse the plurality of tubes and exit through the nozzle, allowing the user to dispense the fluid regardless of how the bottle is tilted.

9 Claims, 2 Drawing Sheets

(56) References Cited

U.S. PATENT DOCUMENTS

| | | | | |
|---|---|---|---|---|
| 10,105,726 | B2 * | 10/2018 | Snyder | B05B 11/0037 |
| 2004/0056052 | A1 * | 3/2004 | Verzino | B65D 83/32 222/464.4 |
| 2004/0075198 | A1 * | 4/2004 | Schweikert | A61M 25/0009 264/464 |
| 2004/0089674 | A1 | 5/2004 | Harrity et al. | |
| 2005/0279773 | A1 * | 12/2005 | Byrd | B05B 11/3057 222/382 |
| 2007/0210122 | A1 | 9/2007 | Giovannoni | |
| 2008/0110937 | A1 | 5/2008 | Guill | |
| 2008/0230564 | A1 | 9/2008 | Jay | |
| 2010/0140303 | A1 * | 6/2010 | Baglin | B05B 11/0059 222/464.4 |
| 2015/0001259 | A1 * | 1/2015 | Nguyen | B05B 15/30 222/464.2 |

* cited by examiner

WEIGHTED MULTITUBE FLUID DISPENSER

CROSS REFERENCE TO RELATED APPLICATIONS

This application claims the benefit of U.S. Provisional Application No. 62/694,228 filed on Jul. 5, 2018. The above identified patent application is herein incorporated by reference in its entirety to provide continuity of disclosure.

BACKGROUND OF THE INVENTION

The present invention relates to fluid dispensers. More specifically, the invention provides a reservoir having a spray head attached, wherein the spray head includes a plurality of tubes having weights affixed to a distal end thereof extending into the reservoir.

Many people use a spray bottle cleaning fluid on a daily or weekly basis to clean areas of their home. However, spray bottles often jam or refuse to produce a spray when tilted, as the rigid tubing within the spray bottle is unable to reach the fluid past a certain point. Additionally, this problem is only increased as the cleaning fluid is used, and as the amount of fluid inside the spray bottle decreases, the spray bottle will cease to function appropriately as the rigid tubing is unable to reach the fluid when it is in a corner of the spray bottle. Thus, an improved weighted multitube fluid dispenser that can efficiently clean regardless of the angle at which it is used is desired.

SUMMARY OF THE INVENTION

In view of the foregoing disadvantages inherent in the known types of fluid dispensers now present in the known art, the present invention provides weighted multitube fluid dispenser wherein the same can be utilized for providing convenience for the user when desiring to dispense a fluid stored within the reservoir efficiently regardless of the angle at which the reservoir is tilted.

The present system comprises a weighted multitube fluid dispenser. The weighted multitube fluid dispenser comprises a reservoir having a top end and a bottom end with an opening disposed at the top end of the reservoir in fluid communication with an interior of the reservoir, wherein the interior is configured to hold liquid therein. The weighted multitube fluid dispenser additionally comprises a spray head, wherein a rim of the spray head is configured to removably secure overtop the opening. A hose extends from an interior of the spray head and splits into a plurality of tubes, each tube having an aperture at a distal end. A weight is affixed to the distal end of each tube, wherein the weight is disposed around the aperture. The spray head additionally comprises a nozzle in communication with the hose, and a trigger disposed adjacent to the nozzle and in communication with the nozzle and the plurality of tubes, such that actuating the trigger causes any fluid disposed in the reservoir to travel up one or more tubes of the plurality of tubes and exit through the nozzle. In this way, a user is able to dispense a fluid stored within the reservoir efficiently regardless of the angle at which the reservoir is tilted.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
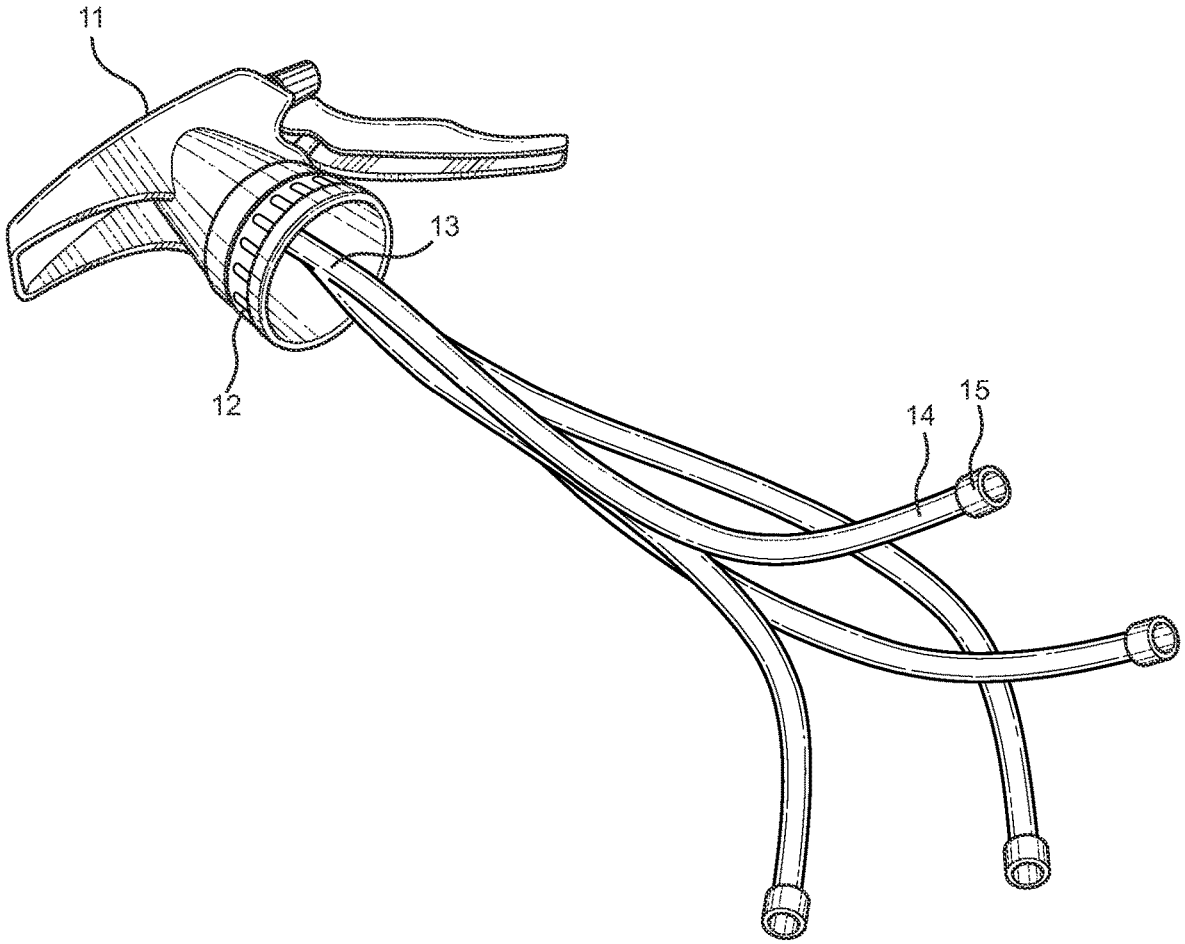
FIG. 1 shows a perspective view of an embodiment of the spray head and the plurality of tubes of the weighted multitube fluid dispenser.

Reference is made herein to the attached drawings. Like reference numerals are used throughout the drawings to depict like or similar elements of the weighted multitube fluid dispenser. The figures are intended for representative purposes only and should not be considered to be limiting in any respect.

Referring now to FIG. 1, there is shown a perspective view of an embodiment of the spray head and the plurality of tubes of the weighted multitube fluid dispenser. A weighted multitube fluid dispenser comprises a spray head 11, wherein the spray head 11 is configured to behave similar to a traditional spray head disposed atop a spray bottle. As such, the spray head 11 includes a rim 12 configured to removably secure the spray head 11 onto a reservoir or bottle. In the illustrated embodiment, the rim 12 is threaded, such that the spray head 11 can rotatably secure atop the bottle.

A hose 13 extends from an interior of the spray head 11, such that, in the illustrated embodiment, the hose 13 extends past the rim 12. The hose 13 splits into a plurality of tubes 14 at a point there along. In the illustrated embodiment, the hose 13 splits into four tubes at a length aligned with the rim 12, such that the plurality of tubes 14 have a greater degree of freedom with respect to movement. However, in other embodiments, the hose 13 splits at a greater length there along, such that the split occurs after the hose 13 has extended past the rim 12, thus preventing the plurality of tubes 14 from potentially becoming tangled.

Each tube 14 includes an aperture at a distal end thereof, wherein the distal end of each tube 14 is disposed opposite to the point wherein the tube 14 splits from the hose 13. Each tube 14 has a length and is configured to conduct a liquid therethrough the full length into the hose 13. In this way, each tube 14 is continuous throughout their length and thus contains no additional apertures thereon. In the illustrated embodiment, the length of some of the tubes 14 is equivalent, such that some of the plurality of tubes 14 have the same length to provide consistent access to any liquid in contact with the plurality of tubes 14. Further, in the shown embodiment, the plurality of tubes 14 vary in length, such that a tube 14A with a shorter length can access the liquid sooner, thereby reducing the total strain placed on each longer tube 14 and extending the overall usage lifetime of the plurality of tubes 14.

In the illustrated embodiment, the plurality of tubes 14 are flexible, such that each tube 14 has an influence coefficient with a value less than one. The flexibility of the plurality of tubes 14 ensures that each tube 14 can be manipulated through rotation to encompass a plurality of positions. Thus, because each tube 14 is not rigidly affixed to the spray head 11, any liquid disposed within a bottle can be reached by at least one tube 14, regardless of where in the container the liquid is displaced. In the shown embodiment, the plurality of tubes 14 do not comprise a single influence coefficient, such that the flexibility of one tube 14 is not equivalent to another tube 14, wherein having at least one tube 14 with a greater influence coefficient allows the respective tube 14 to be more rigid than the remaining tubes 14, thereby preventing the plurality of tubes 14 from becoming tangled.

Each tube 14 has a circumference equivalent to one another, such that the flow of liquid through the plurality of tubes 14 is cons stent, regardless of which tube 14 is used. A weight 15 is affixed to each tube 14 at the distal end thereof, wherein each weight 15 is arcuately shaped such that the weight 15 is disposed around a portion of the circumference of each tube 14. In this way, each weight 15 has an arc length less than the circumference of the respective tube 14 such that the weight 15 does not restrict the flow of liquid through the aperture of the respective tube 14.

Each weight 15 is configured to have a mass heavier than the respective tube 14 the weight 15 is affixed to. Thus, the weight 15 is configured to manipulate the direction of the tube 14, wherein if the plurality of tubes 14 are rotated, such as when the plurality of tubes 14 are disposed within a bottle, the weight 15 corresponds to the lowest point within the bottle, thereby following the flow of liquid, and ensuring the tube 14 is positioned appropriately below a volume of the liquid. Thus, the weight 15 comprises a greater density than the liquid within the bottle. In the illustrated embodiment, each weight 15 is equivalent to one another.

Figure 2:
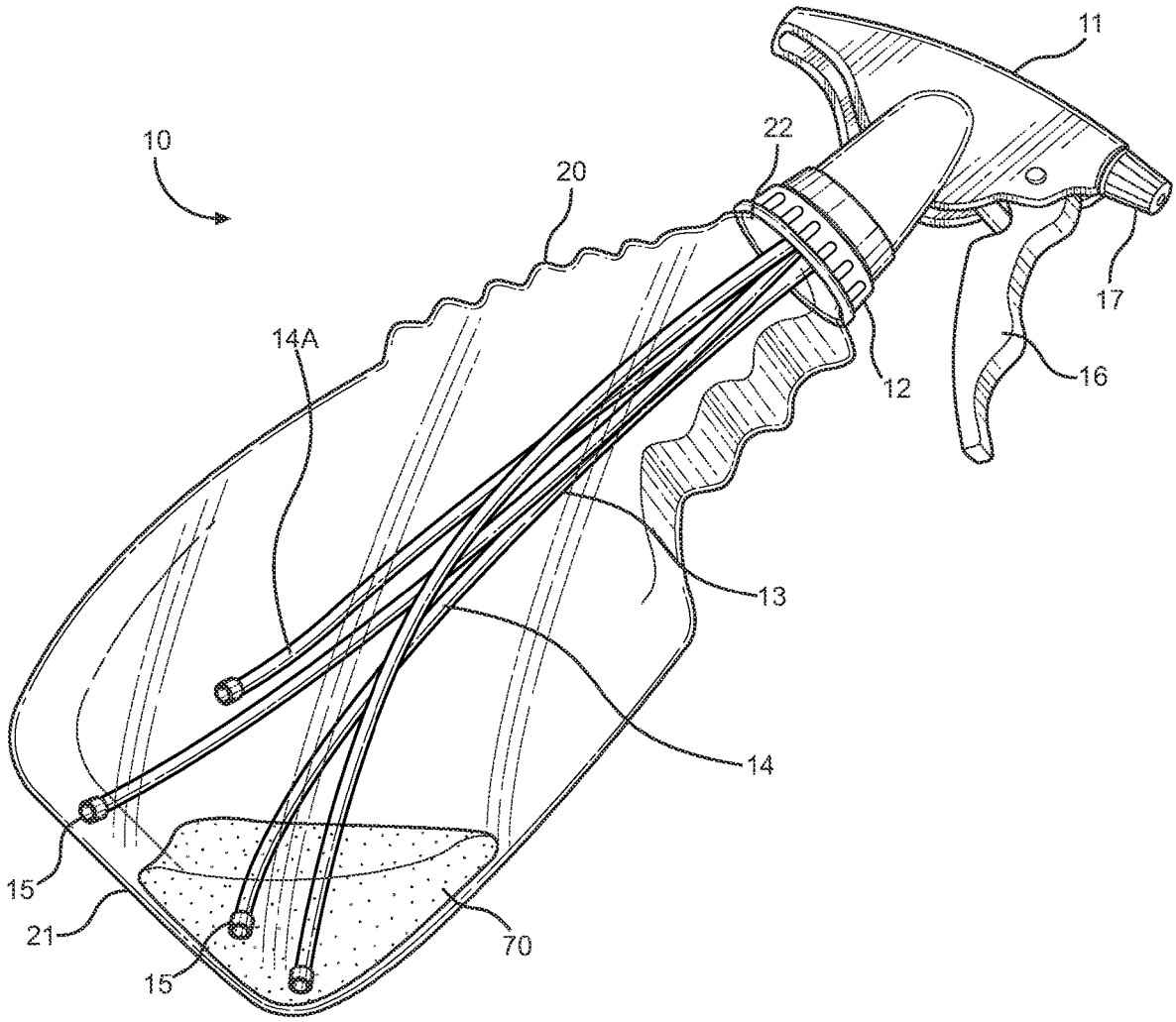
FIG. 2 shows a perspective view of an embodiment of the weighted multitube fluid dispenser in use.

Referring now to FIG. 2, there is shown a perspective view of an embodiment of the weighted multitube fluid dispenser in use. The weighted multitube fluid dispenser 10 includes a reservoir 20 having a top end 22 and a bottom end 21. The bottom end 21 is planar, such that the reservoir 20 can be placed on a flat surface without fear it may accidentally fall over. Further, in the illustrated embodiment the reservoir 20 is configured to be gripped by a hand. In this way, a portion of the reservoir 20 is ridged, such that the ridges are configured to align with fingers from the hand of the user when the reservoir 20 is gripped.

The top end 22 has an opening thereon and is configured to accept the rim 12 of the spray head 11, such that the spray head 11 is removably securable overtop the reservoir 20. The opening at the top end 22 is in fluid communication with an interior of the reservoir 20, wherein the interior of the reservoir 20 is configured to hold liquid 70 therein. In this way, when the spray head 11 is secured overtop the reservoir 20, the hose 13 and plurality of tubes 14 extend therein such that the distal end of each tube 14 and the weight 15 disposed thereon are placed within the liquid 70.

The spray head 11 additionally comprises a nozzle 17 at an end of the spray head 11 disposed perpendicular to the rim 12, wherein the nozzle 17 is in communication with the hose 13. Additionally, a trigger 16 is disposed adjacent to the nozzle 17, wherein the trigger 16 is in communication with the nozzle 17 in addition to the hose 13. In this way, when the trigger 16 is actuated, the liquid 70 travels up at least one of the plurality of tubes 14 to exit through the nozzle 17.

In operation, a user will fill a reservoir 20 with a liquid 70, such as a traditional cleaning fluid. The user will then affix the spray head 11 of the weighted multitube fluid dispenser 10 overtop the opening at the top end 22 of the reservoir 20. In this way, the plurality of tubes 14 extending from the hose 13, wherein the hose 13 extends from the rim 12 of the spray head 11, will extend into the interior of the reservoir 20. Thus, at least one weight 15 at the end of one tube 14 will be disposed within the liquid 70. In this way, when the user tilts the reservoir 20 when cleaning and the liquid 70 is disposed within a corner of the reservoir 20, the weights 15 will follow the liquid 70, such that at least one tube 14 is disposed within the liquid, thereby ensuring the spray function of the spray head 11 is still usable. Thus, the user can dispense the cleaning fluid regardless of the angle at which they tilt the reservoir 20.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A weighted multitube fluid dispenser, comprising:

a reservoir having a top end and a bottom end and configured to hold fluid disposed therein;

an opening disposed at the top end of the reservoir in fluid communication with an interior of the reservoir;

a spray head having a rim configured to removably secure overtop the opening;

a hose extending from an interior of the spray head;

wherein the hose splits into a plurality of tubes, each having an aperture at a distal end thereof, the plurality of tubes including a first tube having a first length and a second tube having a second length that is greater than the first length;

a first weight disposed at the distal end of the first tube and a second weight disposed at the distal end of the second tube, wherein the second weight is heavier than the first weight; wherein the first weight and the second weight surround each aperture;

a nozzle disposed at an end of the spray head in communication with the hose;

a trigger disposed on the spray head operably connected to the plurality of tubes and the nozzle such that actuating the trigger causes the fluid disposed in the reservoir to travel up one or more tubes of the plurality of tubes and exit through the nozzle.

2. The weighted multitube fluid dispenser of claim 1, wherein each tube of the plurality of tubes has a length that extends past the rim of the spray head.

3. The weighted multitube fluid dispenser of claim 1, wherein the plurality of tubes comprises at least two tubes.

4. The weighted multitube fluid dispenser of claim 1, wherein each tube of the plurality of tubes comprises a flexible material.

5. The weighted multitube fluid dispenser of claim 4, wherein each tube of the plurality of tube have different influence coefficients.

6. The weighted multitube fluid dispenser of claim 1, wherein the hose extends past the rim of the spray head prior to splitting into the plurality of tubes.

7. The weighted multitube fluid dispenser of claim 1, wherein the trigger is ergonomic.

8. The weighted multitube fluid dispenser of claim 1, wherein a portion of the reservoir includes a plurality of ridges configured to align with a hand of a user when gripped.

9. A weighted multitube fluid dispenser, consisting of:

a reservoir having a top end and a bottom end and configured to hold fluid therein;

an opening disposed at the top end of the reservoir in fluid communication with an interior of the reservoir;

a spray head having a rim configured to removably secure overtop the opening;

a hose extending from an interior of the spray head;

wherein the hose splits into four tubes, each of the four tubes having an aperture at a distal end thereof, and including a first tube having a first length and a second tube having a second length that is greater than the first length;

a weight disposed at the distal end of each of the four tubes, each weight comprising a cylinder having a central opening that receives the distal end of the tube therethrough;

a nozzle disposed at an end of the spray head in communication with the hose;

a trigger disposed on the spray head operably connected to the plurality of tubes and the nozzle such that actuating the trigger causes fluid disposed in the reservoir to travel up one or more tubes of the plurality of tubes and exit through the nozzle.

* * * * *